US007184068B2

(12) United States Patent
Aspenns et al.

(10) Patent No.: US 7,184,068 B2
(45) Date of Patent: Feb. 27, 2007

(54) SUBSURFACE IMAGED LABELS AND TAGS USING THERMAL TRANSFER RIBBON CARRIER AS OVERLAMINATE AND METHOD OF MANUFACTURE

(75) Inventors: Glenn Aspenns, Cincinnati, OH (US); Matthew Adams, Cincinnati, OH (US); Kevin Conwell, Fairfield, OH (US)

(73) Assignee: Intermec IP Corp., Everett, WA (US)

( * ) Notice: Subject to any disclaimer, the term of this patent is extended or adjusted under 35 U.S.C. 154(b) by 143 days.

(21) Appl. No.: 10/944,556

(22) Filed: Sep. 17, 2004

(65) Prior Publication Data

US 2005/0140768 A1 Jun. 30, 2005

Related U.S. Application Data

(60) Provisional application No. 60/504,423, filed on Sep. 18, 2003.

(51) Int. Cl.
*B41J 2/325* (2006.01)

(52) U.S. Cl. ..... 347/171; 347/213

(58) Field of Classification Search ..... 347/171, 347/213; 400/120.01
See application file for complete search history.

(56) References Cited

U.S. PATENT DOCUMENTS 6,462,765 B1 * 10/2002 Conwell et al. ..... 347/171

* cited by examiner

*Primary Examiner*—Huan Tran
(74) *Attorney, Agent, or Firm*—Seed IP Law Group PLLC

(57) ABSTRACT

A subsurfaced imaged label using a PET thermal transfer ribbon carrier as an overlaminate. A reverse image is printed onto a waste medium. The waste medium and inked reverse image are stripped away. The desired image remains on the PET carrier of the thermal transfer ink ribbon. A pressure sensitive adhesive substrate is laminated onto the carrier on the same side as the ink image. Label stock and another layer of pressure sensitive adhesive is then layered on the ink side of the PET carrier. When the label is applied to a surface the ink image is under the PET carrier and is protected by the PET carrier.

20 Claims, 2 Drawing Sheets

SUBSURFACE IMAGED LABELS AND TAGS USING THERMAL TRANSFER RIBBON CARRIER AS OVERLAMINATE AND METHOD OF MANUFACTURE

This application claims the benefit of U.S. Provisional Application 60/504,423 entitled Subsurface Imaged labels and Tags Using Thermal Transfer Ribbon Carrier as Overlaminate and Method of Manufacture, filed Sep. 18, 2003.

BACKGROUND OF THE INVENTION

1. Field of the Invention

The present invention relates to a durable thermal transfer image. Specifically, it relates to a subsurface imaged thermal transfer label and a method of manufacture.

2. Brief Description of Related Art

Thermal transfer printing traditionally involves variably boding ink from a thin PET carrier (ink, carrier, and release coating comprising a ribbon) to a substrate. A positive image is printed on a substrate. The PET carrier is then stripped away from the substrate, removing the ink from all areas that have not been bonded via heat and pressure. While the printed image is fairly durable, it is subject to attack from abrasion and chemicals, particularly solvents similar to the ones used to coat the ink on the PET carrier.

Traditional approaches to improving durability of the image have required a separate process to overlaminate the printed image with a protective film (usually coated with a pressure sensitive adhesive). This adds complexity to the process, and typically requires either costly equipment or manual labor. Extensive development work has been undertaken to improve the durability of the thermal transfer inks, but some chemicals (usually solvents such as MEK, xylene, toluene, etc.) are still extremely damaging to the printed image.

Chemical resistance is a common challenge in industrial labeling applications, laboratory tracking applications, and other markets. Existing solutions involve costly and unwieldy overlaminating/diecutting stations, extensive manual labor, or expensive and marginally effective ribbon ink. Durable thermal transfer printing applications typically require an expensive, resin based ribbon to achieve good levels of durability.

Many customers are unwilling to overlaminate their labels by hand by applying a separate clear label, and are not interested in the additional cost of the overlaminate film.

SUMMARY OF THE INVENTION

Thermal transfer printing traditionally involves variably boding ink from a thin PET carrier (ink, carrier, and release coating comprising a ribbon) to a substrate. A positive image is printed on a substrate. The PET carrier is then stripped away from the substrate, removing the ink from all areas that have not been bonded via heat and pressure. While the printed image is fairly durable, it is subject to attach from abrasion and chemicals, particularly solvents similar to the ones used to coat the ink on the PET carrier. There is a need for a cost effective durable label.

This invention is a new method of protecting printed images from challenging application conditions such as chemical exposure and abrasion, and is a new product construction.

This invention significantly changes the use of thermal transfer technology. The thermal transfer ribbon is imaged onto a waste medium rather than onto the target substrate.

The waste media and ink is stripped away leaving the desired image on the PET carrier. The carrier, with the desired image remaining, is then laminated onto a pressure sensitive adhesive substrate, creating the finished product. The image is protected from environmental attack by the thin PET film used as the carrier for the thermal transfer ink. This method enables creation of a sub-surface printed image (with corresponding durability) without adding a secondary laminating and diecutting step, without adding the cost of a laminate film, and without the need for an expensive thermal transfer topcoated film. This invention provides a simple and low cost method for producing protected images that will readily endure abrasion and chemical attack.

This invention creates a new use of the thermal transfer ribbon both in print method and film usage, creating a protected image with minimal cost and complexity. This invention provides an inexpensive label for use in challenging conditions. Additional cost savings are realized by the use of inexpensive wax ribbons. Durable thermal transfer printing applications typically require an expensive, resin based ribbon to achieve good levels of durability.

This system for creating a PET protected image can use a less expensive wax based ribbon. This process is on-demand, increasing throughput and reducing the amount of human intervention required in creating sub-surface printed or overlaminated labels and tags. The PET carrier is also chemically coated in order to reduce friction with the printhead; these coatings can also help repel chemical attack.

Thermal transfer ribbons are currently used to create positive images on a target substrate, leaving the surface ink open to attack by abrasion and chemicals.

With the inventive process, negative images of the desired indicia are transferred to a waste substrate, leaving only the desired image on the ribbon carrier. The ribbon carrier is then laminated to a pressure sensitive adhesive label stock, creating a sub-surface printed label. The surface layer of PET protects the image from abrasion, chemical attack, and other environmental conditions that degrade standard thermal transfer images. The finished label can then be cut in some manner, such as by an automated cutter located after the laminating point. An automated cutter can be indexed via a sensor mark image created on the ribbon in the same manner as the other indicia. A cut through the liner (such as a linear slit) would allow easy removal of the liner.

DETAILED DESCRIPTION OF THE INVENTION

Figure 1:
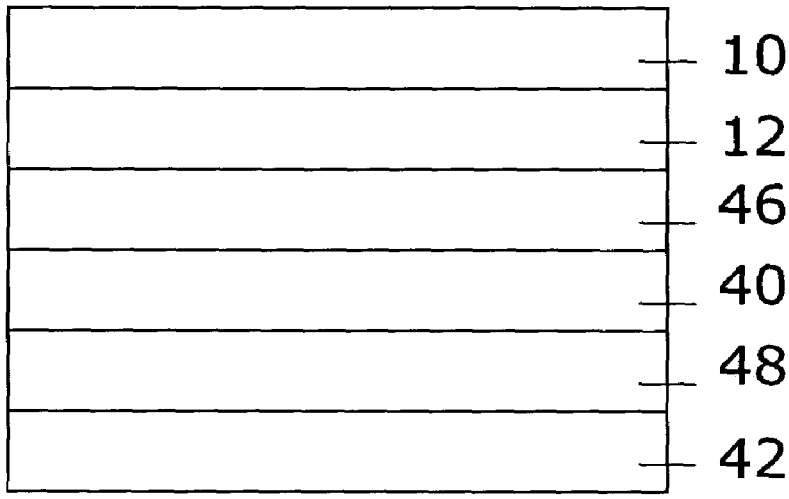
FIG. 1 is an inventive subsurface imaged label.
Figure 2:
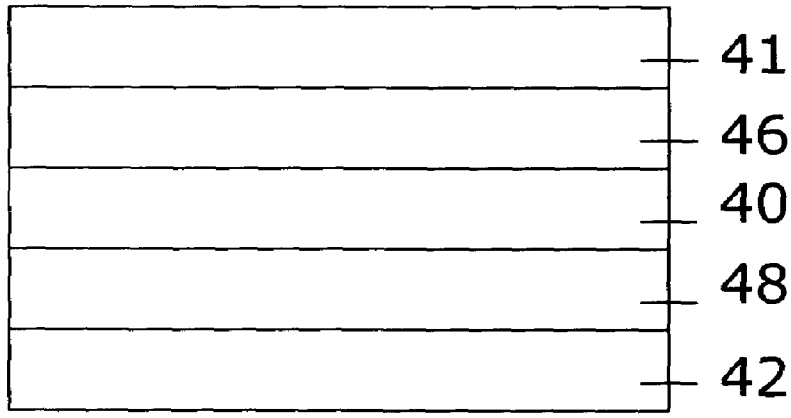
FIG. 2 is first embodiment of a label supply roll.
Figure 3:
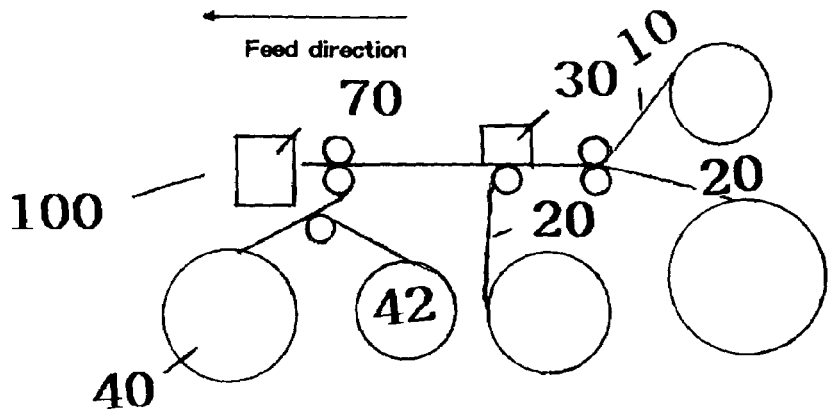
FIG. 3 is a printer for manufacturing the subsurface imaged label.

Thermal transfer printing traditionally involves variably boding ink from a thin PET carrier 10 (ink, carrier, and release coating comprising a ribbon) to a substrate. A positive image is printed on a substrate. The PET carrier 10 is then stripped away from the substrate, removing the ink from all areas that have not been bonded via heat and pressure. While the printed image is fairly durable, it is subject to attack from abrasion and chemicals, particularly solvents similar to the ones used to coat the ink on the PET carrier.

The inventive method is a new method of protecting printed images from challenging application conditions such as chemical exposure and abrasion and an inventive label construction.

This invention changes the use of thermal transfer technology. The thermal transfer ribbon is imaged onto a waste medium 20 rather than onto the target substrate. The negative of the desired image on the waste medium is stripped away leaving the image on the PET carrier 10. The carrier 10, with the desired image remaining, is then laminated onto a pressure sensitive adhesive substrate, creating the finished product. The image is protected from environmental attack by the thin PET film used as the carrier for the thermal transfer ink. This method enables creation of a sub-surface printed image (with corresponding durability) without adding a secondary laminating and diecutting 70 step, without adding the cost of a laminate film, and without the need for an expensive thermal transfer topcoated film.

This system for creating a PET protected image preferably uses a less expensive wax based ribbon as the waste medium 20. This process is truly on-demand, increasing throughput and reducing the amount of human intervention required in creating sub-surface printed or overlaminated labels and tags. The PET carrier is also chemically coated in order to reduce friction with the printhead; these coatings can help repel chemical attack.

With this process, negative images of the desired indicia are transferred to a waste substrate 20, leaving only the desired image on the ribbon carrier 10. The ribbon carrier is then laminated using an adhesive 46 to a pressure sensitive adhesive 4 label stock 40, creating a sub-surface printed label. The surface layer of PET protects the image from abrasion, chemical attack, and other environmental conditions that degrade standard thermal transfer images. The finished label can then be cut in some manner, such as an automated cutter located after the laminating point. An automated cutter 70 can be indexed via a sensor mark image created on the ribbon in the same manner as the other indicia. A cut through the liner 42 (such as a linear slit) would allow easy removal of the liner 42.

Label stock 40 can be chosen based on the application. The process and construction can be used with a variety of stock such as film or paper label stocks. This method can also be used to create over-laminated tags. The label supply roll construction would be as follows: liner, adhesive, tag stock. A self-wound linerless stock could also be used to create tags; an example of the construction in this case would be one tag layer with a release coating and one adhesive layer.

An alternate embodiment would incorporate white thermal transfer ribbon ink printed in standard, positive indicia. The resulting imaged carrier could be laminated to a colored (for example, black) label stock with transparent adhesive, or a white or clear label stock with a colored adhesive. Alternate combinations of color in ribbon ink, film, or adhesive, printed in negative or positive images are also possible with this concept. The resulting imaged carrier would be a mask or stencil. The indicia would appear the color of the carrier or adhesive and be visible against the white ink background.

An alternate embodiment involves laminating the imaged ribbon carrier to transfer adhesive with no base label stock. A linerless transfer adhesive eliminates the need for the liner uptake mechanism. This would result in an extremely thin and flexible label. An opaque white transfer adhesive could be used in order to provide contrast with dark ribbon ink, or vice versa. Clear adhesive could be used if the target substrate provides contrast with the ribbon ink.

Figure 4:
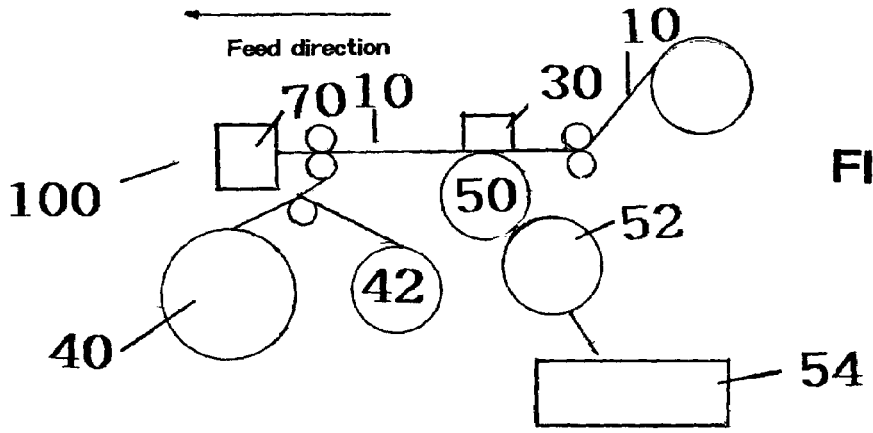
FIG. 4 is an alternative printer for manufacturing the subsurface imaged label.

Referring to FIG. 4, an alternate embodiment incorporates a set of transfer rollers 50 in lieu of a waste medium for removing the thermal transfer ink. The thermal transfer ink would be printed on the transfer roller, leaving the desired image on the ribbon carrier 10. The transfer roller 50 would then transfer the ink onto a heated transfer roller 52, leaving the first transfer roller 50 clean to receive ink when it returns to position under the print head 30. A doctor blade (not show) would remove the ink from the heated transfer roller, dropping it into a waste ink pan 54; the heated transfer roller 52 is then clean and prepared to receive ink from the first transfer roller 50 when it returns to the contact position.

Figure 5:
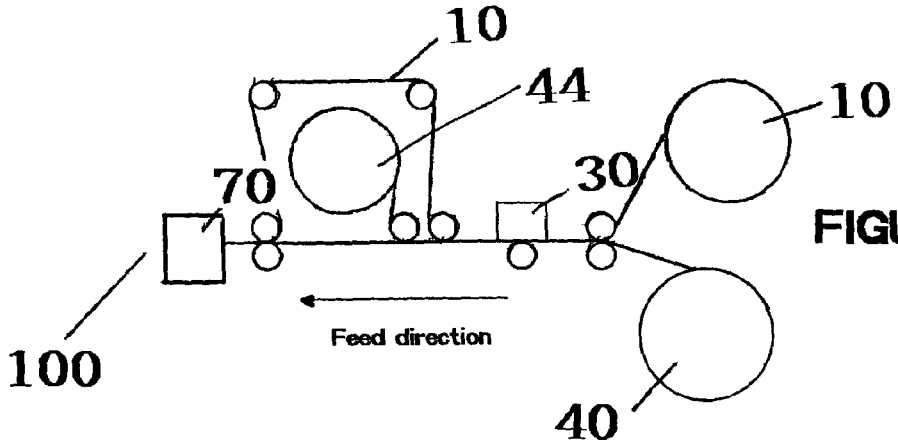
FIG. 5 is an alternative printer for manufacturing the subsurface imaged label.

Referring to FIG. 5, an alternate embodiment incorporates a thermal transfer printable liner 44. After receiving ribbon ink, the liner 44 would be stripped from the label. Either the liner 44 or the ribbon carrier 10 would be deflected from the feed path to allow lamination of the ribbon carrier 10. This would eliminate the need for the thermal transfer paper roll supply, and would eliminate the need for the corresponding feed mechanisms.

An alternate embodiment would incorporate a two-step process, wherein one standard thermal transfer printer would image the ribbon 10 onto a waste substrate 20 and rewind the ribbon 10 onto a core. A second pass through the printer would then laminate the imaged ribbon 10 onto the label or tag stock. Placing two printers in series, processing a continuous web of ribbon, would provide another method for creating this product.

Additional functionality can be incorporated by adding components to the PET carrier such as UV absorbent chemicals.

This construction could allow security functions if the carrier is tinted with a non-carbon black pigment; an IR scanner would read the thermal transfer ink through the black carrier, and the construction would be difficult to duplicate with normal methods.

We claim:

1. A method of manufacturing a subsurface imaged label comprising the steps of:

printing a negative image of a desired image on a waste medium;

stripping away the waste medium to leave the desired image on an ink carrier; and laminating a first adhesive on the side of the ink carrier with the desired image.

2. The method of claim 1 comprising the further steps of:

laminating stock on the first adhesive; and laminating a second adhesive on the stock, wherein the stock is selected from the group consisting of label stock, tag, stock and film.

3. The method of claim 1 wherein a printing medium is a thermal transfer ink on a PET carrier.

4. The method of claim 2 wherein a printing medium is a thermal transfer ink on a PET carrier.

5. The method of claim 1 comprising the further step of applying a release liner over the first adhesive.

6. The method of claim 2 comprising the further step of applying a release liner over the second adhesive.

7. The method of claim 1 wherein the waste medium is a wax based ribbon.

8. The method of claim 2 wherein the waste medium is a wax based ribbon.

9. The method of claim 1 comprising the further step of cutting the ink carrier.

10. The method of claim 2 comprising the further step of cutting the ink carrier and the label stock.

11. The method of claim 1 wherein the first adhesive is a pressure sensitive adhesive.

12. The method of claim 2 wherein the first adhesive is a pressure sensitive adhesive.

13. A method of manufacturing a subsurface imaged label comprising the steps of:

printing a negative image of a desired image on transfer rollers;

stripping away the transfer rollers to leave the desired image on an ink carrier; and laminating a first adhesive on the side of the ink carrier with the desired image.

14. The method of claim 13 comprising the further steps of:

laminating stock on the first adhesive; and laminating a second adhesive on the stock, wherein the stock is selected from the group consisting of label stock, tag, stock and film.

15. The method of claim 13 wherein a printing medium is a thermal transfer ink on a PET carrier.

16. The method of claim 14 wherein a printing medium is a thermal transfer ink on a PET carrier.

17. The method of claim 13 comprising the further step of applying a release liner over the first adhesive.

18. The method of claim 14 comprising the further step of applying a release liner over the first adhesive.

19. A label comprising:

a PET ribbon carrier, a first adhesive layer on the PET ribbon carrier, and a remaining thermal transfer ink image layered between the PET ribbon carrier and the first adhesive.

20. The label of claim 19 further comprising:

second adhesive layer and a stock between the first and second adhesive layer.

* * * * *